US006355309B1

(12) United States Patent
Fleming et al.

(10) Patent No.: US 6,355,309 B1
(45) Date of Patent: Mar. 12, 2002

(54) METHOD OF FORMING A THERMOPLASTIC LAYER ON A LAYER OF ADHESIVE

(75) Inventors: Danny L. Fleming, Stillwater; Ernest M. Rinehart, North St. Paul, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/592,625

(22) Filed: Jun. 13, 2000

Related U.S. Application Data

(62) Division of application No. 09/038,342, filed on Mar. 11, 1998, now abandoned.

(51) Int. Cl.[7] ..... B05D 1/22

(52) U.S. Cl. ..... 427/461; 427/459; 427/208.4; 427/180; 427/370

(58) Field of Search ..... 427/459, 461, 427/208.2, 208.8, 208.4, 202, 366, 371, 180; 428/343, 346

(56) References Cited

U.S. PATENT DOCUMENTS

| | | | | |
|---|---|---|---|---|
| RE24,906 | E | 12/1960 | Ulrich | 206/59 |
| 3,549,403 | A | 12/1970 | Williams et al. | 117/35 |
| 3,561,003 | A | 2/1971 | Lanham et al. | 106/22 |
| 3,821,066 | A | 6/1974 | Tillotson et al. | 161/67 |
| 3,856,900 | A | 12/1974 | Erb | 264/9 |

(List continued on next page.)

FOREIGN PATENT DOCUMENTS

| | | | |
|---|---|---|---|
| DE | 1 933 662 | 7/1969 | |
| DE | 44 27 085 A1 | 2/1996 | D06N/7/02 |
| EP | 0 231 001 | 9/1987 | B05D/7/14 |
| EP | 0 272 659 | 6/1988 | B29B/9/00 |
| EP | 0 259 290 | 9/1988 | B29B/7/88 |
| EP | 0 294 968 | 12/1988 | C08L/27/12 |
| EP | 0 440 840 A3 | 8/1991 | C08F/255/02 |
| EP | 0 440 840 A2 | 8/1991 | C08F/255/02 |
| EP | 0 456 018 A1 | 11/1991 | C09D/5/03 |
| GB | 1 073 044 | 6/1965 | |
| GB | 1 352 356 | 5/1974 | B44D/1/94 |
| GB | 2 240 288 | 7/1991 | B32B/1/08 |
| GB | 2 262 100 A | 6/1993 | C08J/3/12 |
| JP | 38-49421 | 10/1968 | |
| JP | 41-76575 | 12/1969 | |
| JP | 49-12849 | 3/1974 | D21H/1/40 |
| JP | 53-133245 | 11/1978 | C08J/5/16 |
| JP | 57-38840 | 3/1982 | C08K/3/00 |
| JP | 57-58467 | 12/1982 | D06M/15/00 |
| JP | 58-20273 | 2/1983 | B05D/7/24 |
| JP | 59-23541 | 6/1984 | B29C/23/00 |
| JP | 60-038071 | 2/1985 | B05D/7/22 |
| JP | 60-16904 | 4/1985 | B31B/27/60 |
| JP | 60-18536 | 5/1985 | B32B/13/14 |

(List continued on next page.)

OTHER PUBLICATIONS

Power Coating—Powder Application Methods and Equipment No Date.

Powder Coating—Powder Coating Materials No Date.

THV Fluoroplastic—Technical Information—THV 500G No Date.

*Primary Examiner*—Fred J. Parker
(74) *Attorney, Agent, or Firm*—Dale A. Bjorkman; Carolyn A. Peters

(57) ABSTRACT

A method of forming a thermoplastic layer on an adhesive layer is provided. In the steps of the method, a thermoplastic powder is provided having a melt flow index of at least about 0.008 grams/10 minutes, the powder is applied to at least one surface of the adhesive layer to form a particle layer, and the combination is then subjected to elevated heat and pressure until particle layer is fused into a continuous layer and the continuous layer is bonded to the adhesive layer.

9 Claims, 1 Drawing Sheet

U.S. PATENT DOCUMENTS

| | | | | | |
|---|---|---|---|---|---|
| 3,968,275 | A | | 7/1976 | Dees et al. | 427/270 |
| 3,974,303 | A | | 8/1976 | Iwase et al. | 427/27 |
| 4,045,600 | A | | 8/1977 | Williams | 427/379 |
| 4,104,416 | A | * | 8/1978 | Parthasarathy et al. | |
| 4,132,552 | A | | 1/1979 | Paesschen et al. | 96/87 R |
| 4,141,873 | A | | 2/1979 | Dohany | 260/29.6 F |
| 4,185,000 | A | | 1/1980 | Gebauer et al. | 260/452.27 |
| 4,242,380 | A | | 12/1980 | Courtoy | 427/366 |
| 4,255,462 | A | | 3/1981 | Gebauer et al. | 427/27 |
| 4,284,681 | A | | 8/1981 | Tidmarsh et al. | 428/246 |
| 4,286,021 | A | | 8/1981 | Brendley, Jr. | 428/413 |
| 4,556,589 | A | | 12/1985 | Neumann et al. | 428/35 |
| 4,596,623 | A | * | 6/1986 | Matsumoto et al. | |
| 4,605,592 | A | | 8/1986 | Paquette et al. | 428/334 |
| 4,727,111 | A | | 2/1988 | Pettit et al. | 525/190 |
| 4,767,821 | A | | 8/1988 | Lindner et al. | 525/72 |
| 4,770,939 | A | | 9/1988 | Sietses et al. | 428/402 |
| 4,898,779 | A | | 2/1990 | Yoshimura et al. | 428/402 |
| 4,910,046 | A | | 3/1990 | Herwig et al. | 427/195 |
| 4,937,288 | A | | 6/1990 | Pettit, Jr. et al. | 525/176 |
| 4,977,221 | A | | 12/1990 | Yoshimura et al. | 525/356 |
| 5,021,297 | A | | 6/1991 | Rhue et al. | 428/430 |
| 5,030,394 | A | | 7/1991 | Sietses et al. | 264/28 |
| 5,041,287 | A | | 8/1991 | Driggers et al. | 424/81 |
| 5,108,836 | A | | 4/1992 | Ocampo et al. | 428/335 |
| 5,207,954 | A | | 5/1993 | Lewis et al. | 264/13 |
| 5,290,591 | A | | 3/1994 | Lussi et al. | 427/202 |
| 5,344,672 | A | | 9/1994 | Smith | 427/195 |
| 5,399,597 | A | | 3/1995 | Mandel et al. | 523/342 |
| 5,670,237 | A | * | 9/1997 | Shultz et al. | |
| 5,697,037 | A | * | 12/1997 | Yano et al. | |
| 6,180,172 | B1 | * | 1/2001 | Hasenkamp et al. | |

FOREIGN PATENT DOCUMENTS

| | | | |
|---|---|---|---|
| JP | 50-155456 | 8/1985 | B05D/1/28 |
| JP | 60-198225 | 10/1985 | B29D/7/00 |
| JP | 61-108539 | 5/1986 | B29D/9/00 |
| JP | 62-271724 | 11/1987 | B29D/65/02 |
| JP | 4-086254 | 3/1992 | B05D/7/14 |
| JP | 4-179545 | 6/1992 | B32B/31/00 |
| WO | WO 94/00294 | 1/1994 | B32B/31/00 |
| WO | WO 94/06837 | 3/1994 | C08F/259/08 |

* cited by examiner

METHOD OF FORMING A THERMOPLASTIC LAYER ON A LAYER OF ADHESIVE

This is a division of application Ser. No. 09/038,342, filed Mar. 11, 1998, (abandoned) which is incorporated herein by reference.

FIELD OF THE INVENTION

This invention relates to a method of forming a thermoplastic layer on a layer of adhesive.

BACKGROUND OF THE INVENTION

Image graphics are omnipresent in modem life. Images and data that warn, educate, entertain, advertise, etc. are applied on a variety of interior and exterior, vertical and horizontal surfaces. Nonlimiting examples of image graphics range from posters that advertise the arrival of a new movie to warning signs near the edges of stairways.

A surface of an image graphic film requires characteristics that permit imaging using at least one of the known imaging techniques. Nonlimiting examples of imaging techniques include solvent based inks, 100% solids ultraviolet curable inks, water based inkjet printing, thermal transfer, screen printing, offset printing, flexographic printing, and electrostatic transfer imaging.

Electrostatic transfer for digital imaging employs a computer to generate an electronic digital image, an electrostatic printer to convert the electronic digital image to a multicolor toned image on a transfer medium, and a laminator to transfer the toned image to a durable substrate. Electrostatic transfer processes are disclosed in U.S. Pat. No. 5,045,391 (Brandt et al.): U.S. Pat. No. 5,262,259 (Chou et al.); U.S. Pat. No. 5,106,710 (Wang et al.); U.S. Pat. No. 5,114,520 (Wang et al.); and U.S. Pat. No. 5,071,728 (Watts et al.), the disclosures of which are incorporated by reference herein, and are used in the SCOTCHPRINT™ electronic imaging process commercially available from 3M.

Nonlimiting examples of electrostatic printing systems include the SCOTCHPRINT™ Electronic Graphics System from 3M. This system employs the use of personal computers and electronically stored and manipulated images. Nonlimiting examples of electrostatic printers are single-pass printers (Models 9510 and 9512 from Nippon Steel Corporation of Tokyo, Japan and the SCOTCHPRINT™ 2000 Electrostatic Printer from 3M) and multiple-pass printers (Model 8900 Series printers from Xerox Corporation of Rochester N.Y., USA and Model 5400 Series from Raster Graphics of San Jose, Calif., USA).

Nonlimiting examples of electrostatic toners include Model 8700 Series toners from 3M. Nonlimiting examples of transfer media include Model 8600 media (e.g., 8601, 8603, and 8605) from 3M.

Nonlimiting examples of laminators for transfer of the digital electrostatic image include Orca III laminator from GBC Protec, DeForest, Wis.

After transfer of the digital electrostatic image from the transfer medium to a film or tape, optionally but preferably, a protective layer is applied to the resulting imaged film or tape. Nonlimiting examples of protective layers include liquid-applied "clears" or overlaminate films. Nonlimiting examples of protective clears include the Model 8900 Series Scotchcal™ Protective Overlaminate materials from 3M. Nonlimiting examples of protective overlaminates include those materials disclosed in U.S. Pat. No. 5,681,660 (Bull et al.) and copending, coassigned, PCT Pat. Appln. Ser. No. US96/07079 (Bull et al.) designating the USA and those materials marketed by 3M as SCOTCHPRINT™ 8626 and 3645 Overlaminate Films.

Thermal ink jet hardware is commercially available from a number of multinational companies, including without limitation, Hewlett-Packard Corporation of Palo Alto, Calif., USA; Encad Corporation of San Diego, Calif., USA; Xerox Corporation of Rochester, N.Y., USA; LaserMaster Corporation of Eden Prairie, Minn., USA; and Mimaki Engineering Co., Ltd. of Tokyo, Japan. The number and variety of printers changes rapidly as printer makers are constantly improving their products for consumers. Printers are made both in desk-top size and wide format size depending on the size of the finished graphic desired. Nonlimiting examples of popular commercial scale thermal ink jet printers are Encad's NovaJet Pro printers and H-P's 650C and 750C printers. Nonlimiting examples of popular desk-top thermal ink jet printers include H-P's DeskJet printers.

3M markets Graphic Maker Ink Jet software useful in converting digital images from the Internet, ClipArt, or Digital Camera sources into signals to thermal ink jet printers to print such images.

Ink jet inks are also commercially available from a number of multinational companies, particularly 3M which markets its Series 8551; 8552; 8553; and 8554 pigmented ink jet inks. The use of four principal colors: cyan, magenta, yellow, and black permit the formation of as many as 256 colors or more in the digital image.

Current image graphic films contain vinyl chloride polymers, such as marketed by 3M under the SCOTCHCAL™ brand. Alternatively, multilayer films such as disclosed in U.S. Pat. No. 5,721,086 (Emslander et al.) can be used for reception of image graphics. In both instances, specialized coatings are used as the receptor surface on an underlying substrate to improve image graphics transfer and image quality. Regardless, both types of image graphic films have an adhesive layer (and protective release liner until use) on the opposing surface of the film substrate. Thus, image graphic films currently are laminates of some specialized coating, a substrate, an adhesive, and a release liner until use.

In another art, powder coating typically involves applying a specially formulated powder to a substrate by one of several known techniques and then heating the powder in an oven in order to cause the powder to melt and flow to form the coating. The process may also include a curing step to allow a chemical reaction to occur in the coating. The result is a coating with desirable visual and functional properties. A primer may be required to achieve adequate adhesion to the substrate. This method is generally used with metal or heat resistant plastic parts because of the high temperatures that are necessary to achieve complete melting and flowing of the powder. Polymers used in powder coatings typically have a relatively low viscosity when melted so that the powder will be able to form a continuous film under the applied heat. While powder coating is a solvent-free process, it generally requires significant oven cycle times and large, energy-intensive ovens.

A common method of producing polymeric powders for powder coating is to melt and mix the desired resins in a twin screw extruder, extrude and cool the polymer mass and grind the mass to a desired size. The resulting powder, when viewed microscopically, has irregularly-shaped particles with sharp, pointed edges. These particles may exhibit low packing density when deposited on a substrate, resulting in a coating that is susceptible to voids. The irregular shapes also do not achieve the maximum charge to mass ratio as noted in U.S. Pat. No. 5,399,597 that is desirable for certain types of powder coating.

SUMMARY OF THE INVENTION

The present invention has addressed a problem not recognized by the prior art, namely: that image graphic films need not have a film substrate to provide structural integrity between the thermoplastic film and the adhesive, if the thermoplastic film can be formed directly on the adhesive.

The present invention has solved the problems in the art by developing a method of forming a thermoplastic layer on an adhesive layer by powder coating without the use of solvents. The method can be successfully practiced with combinations of polymers that may be chemically incompatible or unstable in processing systems such as emulsions or latices. The method provides a shortened and simplified manufacturing process by avoiding long curing ovens and convoluted web lines, instead relying on the combined application of heat and pressure to the coated substrate. The absence of solvents in the process means that capital costs for scrubbing equipment and special ventilation systems are eliminated, along with the environmental effects associated with solvent coating.

In one aspect, the present invention provides a method of forming a thermoplastic layer on an adhesive layer having two major opposing surfaces. The method comprises the following steps: a) providing a thermoplastic powder having a melt flow index of at least about 0.008 grams/10 minutes; b) applying the powder to at least one major surface of the adhesive layer to form a particle layer; and c) subjecting the particle layer of step b) to elevated heat an pressure until the powder in the particle layer is fused into a continuous layer and the continuous layer is bonded to the adhesive layer. The melt flow index of the powder is preferably in the range from about 0.008 grams/10 minutes to about 50 grams/10 minutes.

As used herein, "melt flow index" refers to a measure of the rate of polymer melt flow through a capillary and is measured at 190° C. according to ASTM Method D-1238 for polypropylene. The reported index is the average of three measurements. A lower melt flow index indicates a slower-flowing, more viscous polymer that is likely to be relatively high in molecular weight.

"Fused" means that the powder particles have melted at least partially and have joined with adjacent powder particles sufficiently to form a continuous layer.

"Joined" means that adjacent powder particles no longer have a distinct boundary layer when viewed under magnification.

"Continuous" means that the layer covers or surrounds the entire substrate with substantially no gaps or pin holes having a size greater than is considered acceptable for a particular application. It is not required that the continuous layer be a completely homogeneous film. The continuous layer may be formed from a monolayer of particles, or from more than one layer of stacked particles.

"Bonded" means that the bond strength between the continuous layer and the substrate is greater than the internal tensile strength of the weaker layer.

The term "thermoplastic" refers to materials that soften and flow upon exposure to heat and pressure. Thermoplastic is contrasted with "thermoset", which describes materials that react irreversibly upon heating so that subsequent applications of heat and pressure do not cause them to soften and flow.

"Two-dimensional" with reference to the substrate means that the substrate is a sheet having two major opposing surfaces that is capable of passing through a nip roll configuration.

For this invention, the application of heat and pressure is preferably accomplished by passing the coated substrate through a heated nip roll configuration using readily available equipment. One skilled in the art can choose thermoplastic powder compositions that will yield useful thermoplastic layers having a variety of properties, such as dirt and stain resistance, ink and graphics receptivity, and porosity.

In another aspect, the present invention provides a composite sheet material comprising an adhesive layer having two major opposing surfaces and a thermoplastic layer overlying and bonded to at least one major surface of the adhesive. The thermoplastic layer is continuous and comprises a fused thermoplastic powder. The powder has a melt flow index ranging from about 0.008 grams/10 minutes to about 50 grams/10 minutes, and preferably about 1 grams/10 minutes to about 35 grams/10 minutes. Preferably, the composite sheet material is useful as an outdoor sign and the powder comprises a ionomer or a vinyl chloride polymer.

A feature of the invention is low profile of the composite sheet material because of the elimination of the film substrate that was previously provided for structural integrity rather than for imaging.

An advantage of the invention is the reduction in cost of the composite sheet material because of the elimination of the film substrate and the attendant production steps to make that film substrate.

Another advantage of the invention is the lower profile of the composite sheet material results in a more conformable, more receptive image graphic film due to the absence of the film substrate and the softness of the combination of the thermoplastic layer and the adhesive layer.

Another advantage of the invention is the avoidance of pollution abatement equipment because the method of the invention is a solventless process.

Another advantage of the invention is the method of the present invention avoids the use of extrusion processes where the possibility of the extrusion head contacting the adhesive layer is problematic to error-free processing.

Another advantage of the invention is the use of a powder coating process to prepare a continuous layer of a thermoplastic film on an adhesive layer which provides good dimensional stability in the thermoplastic film, because such film is formed without polymeric orientation inherent in extrusion processes.

Another advantage of the invention is that the method uses no thermal oxidizer, providing lower operating cost to make the thermoplastic film via powder coating processes.

Embodiments of invention are further described with reference to the following description.

EMBODIMENTS OF THE INVENTION

Method of Producing Thermoplastic Layer

Figure 1:
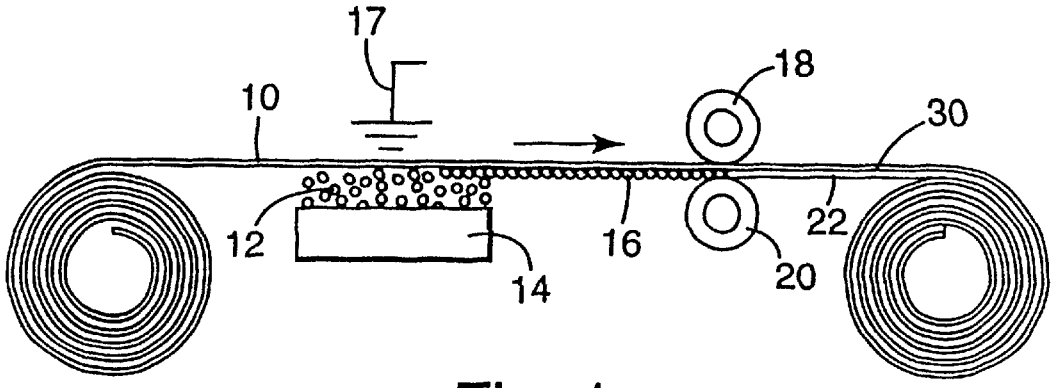
FIG. 1 is a schematic cross-sectional view of the method of producing a thermoplastic layer on an adhesive according to this invention.
Figure 2:
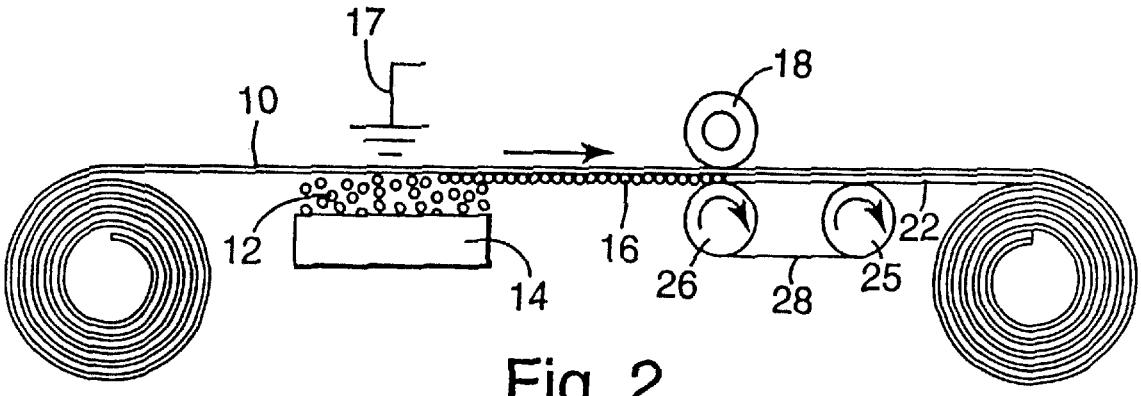
FIG. 2 is a schematic cross-sectional view of an alternate method of producing the image graphic film according to this invention.

FIG. 1 schematically illustrates a method of producing a thermoplastic layer on a flexible substrate according to this invention. Further, one skilled in the art is directed to U.S. Pat. No. 5,827,608 the disclosure of which is incorporated herein by reference, for a further explanation of producing a thermoplastic layer using powder coating techniques.

Two-dimensional adhesive layer 10 (which itself resides on a protective liner with a siliconized release surface contacting the adhesive) moves through powder cloud 12 emanating from electrostatic fluidized bed powder coater 14 so that a particle layer 16 is formed on one surface of the adhesive layer 10. The powder particles in powder cloud 12 are shown much larger than actual size for the purposes of illustration. Adhesive layer 10 may be in the form of a long continuous web (as shown), or it may be a smaller piece of material laid on a carrier web. In a technique well known in the art (see for example "Powder Coating", edited by Nicholas P. Liberto, published by the Powder Coating Institute, 1994, Chapter 10.), powder cloud 12 is generated by placing a powder suitable for powder coating in the chamber of the coater and passing ionized air through the powder until it fluidizes. Preferably, the powder is predried in a conditioning chamber (not shown) before entering the coater. A grounding plate 17 made of aluminum or other like material can be placed behind the substrate to provide a ground potential to attract the charged powder to the surface of the substrate. The coating weight of the particle layer 16 is controlled by the line speed, the voltage applied to the air supply, and the particle size of the powder. Both surfaces of the substrate may be coated by passing the substrate between two powder coaters, or by making two passes over the same coater and inverting the substrate between passes.

Although electrostatic fluidized bed powder coating is the preferred method for continuous coating of essentially two-dimensional substrates, other types of powder coating methods such as electrostatic spray coating may be used instead. Powder coating equipment is well known and complete systems are readily available commercially. A nonlimiting example of a powder coating equipment manufacturer is Electrostatic Technology Incorporated (ETI), Branford Conn., USA.

The coated substrate then passes through a nip configuration defined by heated roll 20 and backup roll 18. The nip configuration applies heat and pressure simultaneously to fuse the powder in the particle layer 16 into a continuous thermoplastic layer 22 and bond the layer to adhesive layer 10, thereby forming a composite sheet material 30. No preheating stage is required prior to the nip, but such a stage may be useful to achieve a higher line speed. Heated roll 20 is typically made of metal and its outer surface is preferably covered with a material having release properties, such as poly(tetrafluoroethylene) commercially available under the tradename TEFLON® from E. I. Dupont de Nemours and Co. of Wilmington, Del., to prevent the transfer of either melted thermoplastic powder or the fused thermoplastic layer from the adhesive layer to the roll. Backup roll 18 preferably has a resilient surface, such as rubber.

The temperature of the heated roll is chosen to be high enough to fuse the powder into a continuous layer, yet not so high as to distort or degrade the adhesive layer 10. Generally, for most powders chosen, the temperature of the heated roll ranges from about 148° C. to about 260° C. and preferably from about 163° C. to about 190° C. If adhesive layer 10 is likely to soften or distort at the elevated temperatures in the nip, support should be provided to the substrate in the form of a carrier web, liner or belt system (not shown) to prevent distortion of the substrate in the heated nip configuration. The backup roll may be at ambient temperature, or it may optionally be chilled to provide further thermal protection for the substrate. The nip pressure between heated roll 20 and backup roll 18 is sufficient to fuse the heated particle layer but not so high as to distort the adhesive layer. Skilled persons can adjust nip pressure (usually via an air pressure valve measured in kilopascals (kPa) or pounds per square inch (psi)) to achieve the desired result.

As an alternative to the continuous coating process described above, the method may be conducted as a batch process on individual pieces of the substrate.

Adhesives

Suitable adhesives include any adhesive (e.g., structural, pressure-sensitive, etc.) capable of receiving a powder coating and capable of withstanding the heat and pressure in the process described above. The adhesive can be used in conjunction with a supporting release liner, or internally reinforced in order to meet process requirements. The thickness of the adhesive is in the range from about 10 to about 250 microns. Preferably, the range is from about 25 to about 50 microns.

Nonlimiting examples of adhesives include pressure sensitive adhesives generally found in Satas, Ed. *Handbook of Pressure Sensitive Adhesives,* 2 Ed. (Von Reinhold Nostrand 1989). Of these adhesives, desirable adhesives include solvent-based acrylic adhesives, water-based acrylic adhesives, hot melt adhesives, microsphere-based adhesives, and silicone-based adhesives, regardless of their method of preparation. Preferably, the invention uses acrylate based pressure sensitive adhesives such as those disclosed in U.S. Pat. Nos. 2,973,826; Re 24,906; Re 33,353; 3,389,827; 4,112,213; 4,310,509; 4,323,557; 4,732,808; 4,917,928; 4,917,929; and European Patent Publication 0 051 935, all incorporated herein by reference.

Powders

Powders suitable for powder coating in the method of this invention comprise one or more thermoplastic polymers chosen to give desirable properties in the thermoplastic layer. Such properties include weatherability, durability, dirt resistance, flexibility, toughness, adhesion to adhesive layer, and receptivity to inks and toners. Nonlimiting examples of suitable thermoplastic polymers include polyvinyl chloride (PVC), polyamide, ionomer, polyester, polyacrylate, polyethylene, polypropylene, and fluoropolymer. As used herein, a fluoropolymer contains at least about 10% by weight fluorine. For example, in a powder comprising polymethylmethacrylate (PMMA) and a fluoropolymer, the PMMA will provide good adhesion to adhesive layer, and the fluoropolymer will provide good weatherability and dirt resistance. In addition, the powder can optionally include other ingredients such as plasticizers, stabilizers, flow aids to improve coating uniformity, pigments, ultraviolet (UV) absorbing agents, and extenders that are well known in the art.

The powder desirably has a combination of particle size, melt flow index, and heat stability that contributes to successful powder coating. The powder must also be fluidizable if an electrostatic fluidized bed powder coater is to be used. A powder is fluidizable if, when air is percolated through it, it is able to form a powder cloud and behave substantially like a liquid.

The particle size is preferably in the range from 10 to 200 $\mu$m, and more preferably 10 to 50 $\mu$m. Although particle sizes outside this range may also be suitable, particles smaller than 10 μm may present explosion hazards during powder coating, and particles larger than 200 μm may be difficult to charge and will produce an overly thick thermoplastic layer that is difficult to fuse.

Melt flow index should be high enough for the powder to melt and flow sufficiently upon heating, while still low enough for the resultant thermoplastic layer to have acceptable physical properties. When a heated nip is used to fuse the particle layer according to the method of this invention, powders with a relatively lower melt flow index can be used as compared to powder coatings where the powder must melt and flow under applied heat only. As previously noted however, the heated roll surface contacting the powder in the particle layer preferably has a release coating such that the powder will remain on the adhesive layer and not adhere to the surface of the heated roll. By selecting the proper release coating for the heated roll and providing support to the incoming adhesive layer if necessary, powders with a wide range of melt flow index values can be successfully used in the method of this invention. The melt flow index can be as low as about 0.008 grams/10 minutes, and is preferably in the range from about 1.0 to about 35 grams/10 minutes. Polyethylene, a commonly used polymer for standard powder coating processes, has a melt flow index in the range from about 10 to 45 grams/10 minutes. The powder should be stable at the temperature that will be applied to the powder coated adhesive during processing, e.g., it should not show a significant color change or other evidence of heat degradation.

Thermoplastic powders suitable for powder coating may be purchased from commercial vendors or made by one of several production methods. Examples of commercially available thermoplastic powders include Surlyn branded powders such as AB106 Neutral ionomer powder from DuPont of Wilmington, Del., USA, DURAVIN® vinyl and PVC powders and DURALON® powders from Thermoclad Company, polyvinylidene fluoride powder under the tradename KF POLYMER® from Continental Industries, Inc., and THV-500P fluoroterpolymer powder from Dyneon LLC.

Powders are commonly manufactured by either a melt-mixing or a dry-blending process, as described in D. S. Richart. "Powder Coatings" In *Kirk-Othmer Encyclopedia of Chemical Technology Third Edition,* edited by Martin Grayson, vol. 19. John Wiley and Sons, 1982. In a preferred approach, the powder is made by the following method. Each of the polymer(s) desired to be included in the powder are first prepared as a water-based latex by emulsion polymerization or a like method. The particle size of the polymer in each latex should be much smaller than the desired finished powder particle size in order to obtain the most uniform blend of the polymers in each powder particle. A range of 2 times to 1000 times smaller is useful. Preferably, the range is 50 to 300 times smaller. The latices are then mixed together using mixing equipment commonly used for latices, such as a low shear mixer. At the same time, optional additives such as ultraviolet (UV) absorbing agents, flow aids, colorants and heat stabilizers can be mixed in.

From a manufacturing standpoint, it is preferable for the various latices to be miscible with one another in the mixture. "Miscible" means that in combining the latices the dispersions are retained and coagulation does not occur. Coagulation of the various latices can sometimes be prevented by pH adjustment prior to mixing or by adding one latex to another very slowly. The resulting mixture is preferably spray dried using readily available equipment to form substantially spherical particles. Alternatively, the latices may be pumped separately into the nozzle of the spray drying apparatus so that they mix in the nozzle immediately before spray drying occurs, or the various latices may be spray dried separately and the resulting powders afterwards combined. Particles that have been previously formed by spray drying or some other method may also be metered into the latex stream at the nozzle. Suitable operating conditions for the spray drying apparatus may be determined by one skilled in the art to obtain particles within the desired size range. Although particles produced by this method are relatively uniform in size, the particles can then be optionally graded, such as by passing through sieves, to obtain a narrower size distribution.

As an alternative method to spray drying, the latex mixture described above may be dried into a solid mass by evaporation and thereafter ground into particles that are not substantially spherical.

A particularly preferred thermoplastic powder comprises a (meth)acrylate polymer and a fluoropolymer, and has a melt flow index ranging from about 0.008 grams/10 minutes to about 0.02 grams/10 minutes. The weight ratio of (meth) acrylate polymer to fluoropolymer is in the range from 1:1 to 99:1. The ratio chosen will depend in part upon the properties desired in the intended application. For example, a higher proportion of (meth)acrylate polymer promotes better adhesion to an adhesive layer, while a higher proportion of fluoropolymer imparts more dirt resistance properties and is believed to increase flexibility of the resulting thermoplastic layer. A practical weight ratio range for many applications is between 2:1 and 5:1. The particle size of the preferred powder is preferably in the range from about 10 μm to about 50 μm. Most preferably, the (meth)acrylate polymer is polymethylmethacrylate (PMMA) and the fluoropolymer is a copolymer of monomers comprising chlorotrifluoroethene and vinylidene fluoride in a weight ratio of about 45:55 chlorotrifluoroethene to vinylidene fluoride. For this powder, the weight ratio of PMMA to the fluoropolymer is in the range from 2:1 to 5:1.

A preferred polymethylmethacrylate polymer useful for the thermoplastic powder is made by Zeneca Resins of Wilmington, Mass. under the tradename NEOCRYL A-550®. This PMMA resin is available in latex form and has a melt flow index of 0.008465, indicating a relatively high molecular weight. The preferred fluoropolymer for the thermoplastic powder is commercially available from Dyneon LLC of St. Paul, Minn., USA in latex form under the tradename KEL-F 3700. The NEOCRYL® and KEL-F latices are compatible and stable when blended in all ratios as shown by differential scanning calorimetry (DSC) evaluation. There are literature references to the compatibility of polyvinylidene fluoride (PVDF) with polymethacrylate polymers (see for example E. M. Woo, J. M. Barlow, and D. R. Paul. *J Appl. Polym. Sci.* (30), 4243, 1985) based on glass transition temperatures of the polymer blends. PVDF/polymethacrylate blends tend to embrittle with age because of the crystalline nature of PVDF, although attempts have been made to avoid this result. (C. Tournut, P. Kappler, and J. L. Perillon. *Surface Coatings International* (3), 99, 1995). PMMA blended with the chlorotrifluoroethene/vinylidene fluoride copolymer as described above, however, does not embrittle with age as happens when PMMA is blended with a PVDF homopolymer because of the amorphous nature of the fluorinated copolymer.

To make the preferred powder, 3 parts of the NeoCryl PMMA latex are mixed with 1 part of the KEL-F fluoropolymer latex to form a latex blend. The latex blend is preferably spray dried to form substantially spherical particles. With the proper selection of spray drying conditions such as nozzle design, air temperature, and air pressure, the desired particle size distribution of 10 to 50 μm can be obtained by a person skilled in the art of spray drying. The powder has the proper size range to be powder coated by the electrostatic fluidized bed method without further grinding, sizing or otherwise modifying the physical structure of the powder.

At a weight ratio of 3:1 (PMMA:fluoropolymer) based on solids, the powder has a melt flow index of 0.0128 grams/10 minutes. This powder is especially preferred for use in the coating method of this invention described above.

According to currently practiced powder coating methods, a powder with a melt flow index as low as 0.0128 would be useless because the powder would not be able to flow sufficiently under applied heat to form a continuous film. Powders having a higher melt flow index such as polyethylene are considered suitable for this type of method. If a combination of heat and pressure are employed as described by the method of the present invention, however, the powder with a low melt flow index will flow and will form a continuous layer, even on an adhesive that is very soft at the fusion temperature of the powder.

Figure 3:
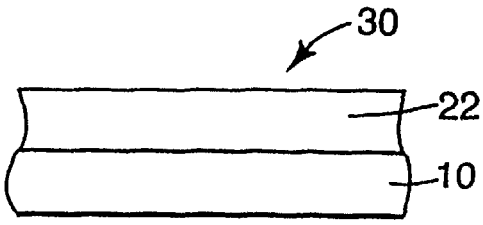
FIG. 3 is a schematic cross-sectional view illustrating the composite sheet material of this invention.

Composite sheet material 30 made according to this invention is shown in FIG. 3. Thermoplastic layer 22 overlies and is bonded to adhesive layer 10 form a continuous coating. The thermoplastic layer can be translucent, transparent or opaque in appearance, and generally has a thickness in the range from about 10 μm to about 65 μm (0.5 mil to 2.5 mils). An example of a protective layer for outdoor sign substrates is translucent and has a thickness in the range from 10 μm to 25 μm (0.5 mil to 1 mil). The powder used in this protective layer comprises a (meth)acrylate polymer and a fluoropolymer.

The following nonlimiting example provides further illustrations of the invention.

EXAMPLE

Continusou Coating of Thermoplastic Layer on Substrate

A 15.2 cm wide roll of adhesive-coated paper liner (25.4 μm thick layer of 95/5 isooctylacrylate/acrylic acid pressure sensitive adhesive on a silicone release surface of a 127 μm thick paper liner) (3M) was placed on an unwind stand and threaded through an opening cut in the shroud of a C-30 electrostatic fluidized bed powder coater (Electrostatic Technology, Inc., Branford, Conn.). The adhesive-coated paper liner was then threaded through a nip comprising a heated roll and a backup roll and onto a windup stand. The face of the heated roll had been previously coated with a material called Rich Coat supplied by Toefco Engineering, Niles, Mich., 49120. A grounded aluminum plate was placed behind the substrate. The arrangement was similar to that shown in FIG. 1. AB106 Neutral ionomer from DuPont, Wilmington, Del., USA having a melt flow index of 34.7787 was then coated on the substrate with the coater voltage set at 42 kV and the adhesive-coated paper liner moving at 0.8 m/min. The coating weight was approximately 2 mg/cm$^2$. The particle layer was fused by the nip with the heated roll set at 165° C. and the applied air pressure to the nip set at 276 kPa (40 psi). After the particle layer was fused and bonded to the adhesive to form the thermoplastic layer, the liner was removed, leaving a material comprising the adhesive layer attached to the thermoplastic layer.

The material was tested for stain resistance as follows:

The word "TEST" was written on the thermoplastic layer surface of the material (or uncoated substrate surface) with a SANFORD Series 30000 SHARPIE Fine Point red permanent marking pen. After one minute, the sample surface was wiped with a cloth saturated with isopropyl alcohol. Any residual red stain remaining after the alcohol wipe was judged a failure of the test because the adhesive will have become stained with the red ink indicating a discontinuity in the thermoplastic layer. The material passed the stain resistance test.

The composite sheet material produced in this Example was also evaluated for ink/toner receptivity on the thermoplastic layer as follows: A multicolored weather bar graphic was imaged on a SCOTCHPRINT™ 8601 transfer media (from 3M) using SCOTCHPRINT™ toners in a SCOTCHPRINT™ 9512 electrostatic printer. The toned image on the transfer medium was then placed in contact with the thermoplastic layer of the composite sheet material produced in this Example and the two sheets were passed through a Pro-Tech Model 9540 hot roll laminator set at 96° C. and running at 0.3–0.6 m/min. Resulting image transfer quality onto the thermoplastic layer of the composite sheet material was judged visually to be excellent. The material passed the stain resistance test and showed good ink/toner receptivity. The ink/toner receptivity results indicate that the composite sheet material could be useful as an adhesive-backed image graphic film.

The invention is not limited to these embodiments. The claims follow.

What is claimed is:

1. A method of forming a thermoplastic layer on a flexible adhesive layer free of a film substrate having two major opposing surfaces comprising:

providing a thermoplastic powder having a melt flow index of about 0.008 grams/10 minutes or greater;

applying the powder in the absence of solvents to at least one major surface of the adhesive layer to form a particle layer; and subjecting the particle layer to elevated heat and pressure until the powder in the particle layer is fused into a continuous layer that is bonded to the adhesive layer.

2. The method of claim 1, wherein the thermoplastic powder has a melt flow index of about 0.008 grams/10 minutes to about 50 grams/10 minutes.

3. The method of claim 1, wherein the thermoplastic powder has a melt flow index of about 0.008 grams/10 minutes to about 35 grams/10 minutes and comprises an ionomer polymer.

4. The method of claim 1, wherein the adhesive layer is a pressure sensitive adhesive.

5. The method of claim 1, wherein the heat and pressure are applied simultaneously by passing the adhesive layer coated with the particle layer through a heated nip configuration comprising a heated roll having an outer surface and a backup roll.

6. The method of claim 5, wherein the heated nip configuration further comprises an unheated roll proximate to the heated roll and a belt passing around the heated roll and the unheated roll such that after the coated substrate passes between the heated roll and the backup roll, the belt contacts the continuous layer for a period of time sufficient for the continuous layer to solidify.

7. The method of claim 5, wherein the heated roll comprises a release coating covering the outer surface.

8. The method of claim 5, wherein the adhesive layer is supported by a carrier web through the heated nip configuration.

9. The method of claim 1, wherein the powder is applied by electrostatic fluidized bed powder coating.

* * * * *

UNITED STATES PATENT AND TRADEMARK OFFICE

CERTIFICATE OF CORRECTION

PATENT NO. : 6,355,309 B1
DATED : March 12, 2002
INVENTOR(S) : Fleming, Daniel L.

It is certified that error appears in the above-identified patent and that said Letters Patent is hereby corrected as shown below:

Title page,
Item [57], References Cited, FOREIGN PATENT DOCUMENTS, insert
-- JP 55-025402 2/1980……...C08J/5/16 --

Column 3,
Line 32, delete "an" and insert in place thereof -- an --.

Column 7,
Line 36, after "DURALON®" insert -- nylon --.

Signed and Sealed this

Fifteenth Day of October, 2002

*Attest:*

*Attesting Officer*

JAMES E. ROGAN
*Director of the United States Patent and Trademark Office*